United States Patent [19]

Conroux et al.

[11] 3,982,409

[45] Sept. 28, 1976

[54] WEFT-KNITTING METHOD AND APPARATUS

[75] Inventors: Jean-Jacques Conroux, Sciez-Jussy, France; Daniel Pilet, Borex (Vaud), Switzerland; Christian Roehrich, Archamps, France

[73] Assignee: Battelle Memorial Institute, Carouge-Geneve, Switzerland

[22] Filed: Nov. 18, 1975

[21] Appl. No.: 633,105

[30] Foreign Application Priority Data

Nov. 19, 1974 Switzerland ..... 015357/74

[52] U.S. Cl. ..... 66/1 R

[51] Int. Cl.[2] ..... D04B 35/00

[58] Field of Search ..... 66/1 R, 1 A, 82, 85 A

[56] References Cited

UNITED STATES PATENTS 391,084 10/1888 Schmitt ..... 66/1 R 421,526 2/1890 Schmitt ..... 66/1 R

*Primary Examiner*—Henry S. Jaudon

*Attorney, Agent, or Firm*—Karl F. Ross; Herbert Dubno

[57] ABSTRACT

A weft-knitting apparatus is provided with an axially nondisplaceable but rotatable loop-forming element having an upper end cut off at an oblique angle and formed with a spur. Each loop-forming element is periodically rotated 360° so as to pick up a filament with its spur to pull it through a loop previously formed, thereby forming another loop that can thereafter slip up over another loop so formed by the spur. The support carrying a plurality of such rotatable elements may be exchanged for another such support having elements differently spaced in order to use the same knitting machine for different gauges or cuts.

8 Claims, 14 Drawing Figures

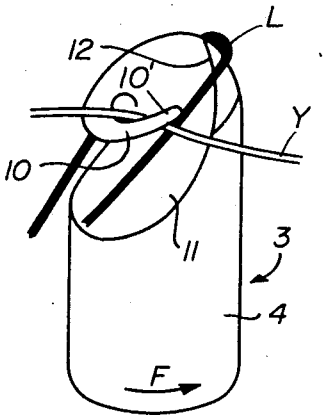
FIG. 4a
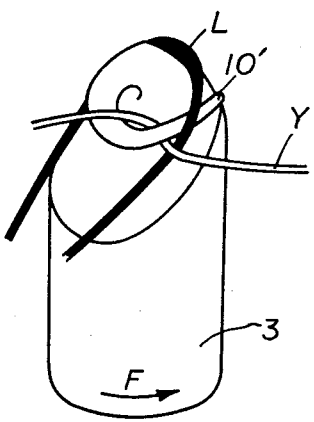
FIG. 5a
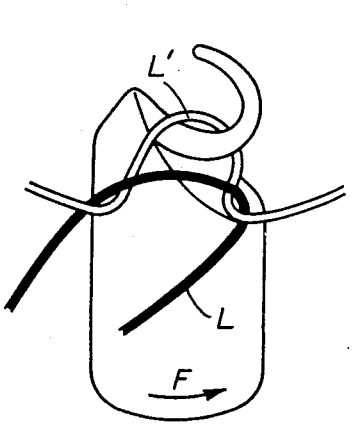
FIG. 6a
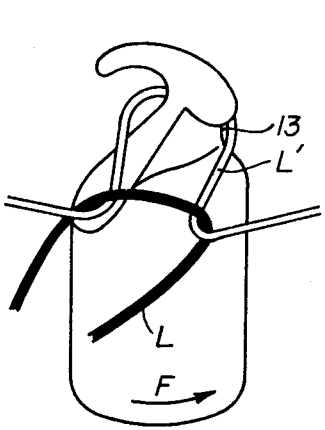
FIG. 7a
FIG. 4b
FIG. 5b
FIG. 6b
FIG. 7b FIG. 9
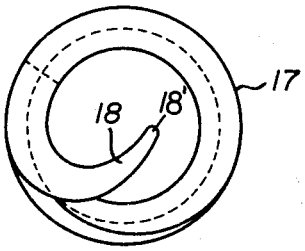
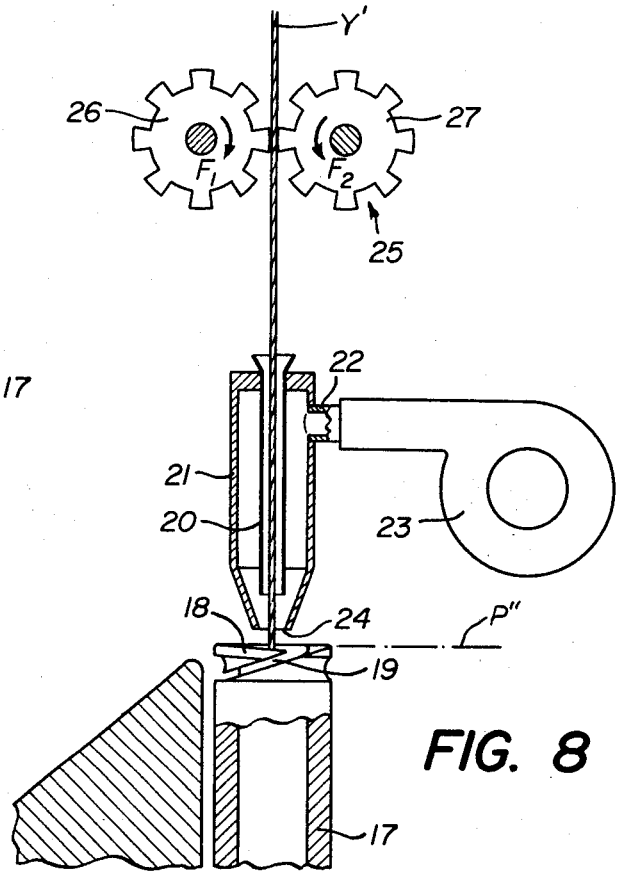
FIG. 8
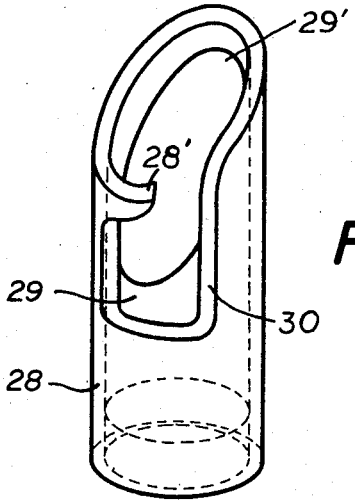
FIG. 10

WEFT-KNITTING METHOD AND APPARATUS

FIELD OF THE INVENTION

The present invention relates to a method of and an apparatus for weft knitting.

BACKGROUND OF THE INVENTION

In known knitting methods successive stitches or loops are formed and interlaced by means of needles which may or may not be provided with latches. These needles are mounted in a row in a cylinder of a circular knitting machine or a needle bed of a flat knitting machine. In the lattery type of machine the needle support is an elongated element provided with an array of parallel needle seats extending perpendicular to the longitudinal direction of the element. In circular knitting machines the needle support is provided on its periphery with an array of parallel needle seats corresponding to generatrices of the cylinder. In both cases the needles are displaced longitudinally of their seats. With each reciprocal movement each needle slides along a stitch or loop which it has just formed and hooks on a thread or filament which is to form the next stitch or loop, returning backwardly with the previous stitch sliding off the tip of the needle around the thread that was just picked up. A loop of this thread is thus pulled through the loop already around the needle and the previously formed loop slides off the needle around the newly formed loop.

The reciprocal movements of the needles are effected by means of fixed or movable cams. In circular machines the cams can be fixed in which case the cylinder turns around its axis, or movable in which case the cylinder is fixed. In flat-bed machines the cams are always carried by a carriage which is displaced along the needle support.

These machines, although they produce perfectly usable knitted goods, are relatively complicated and very expensive. The needles must be extremely carefully machined in order not to catch on the stitches, and the joints of their latches, where provided, must have a very exactly controlled play. The body of the needles must have thicknesses which are extremely regular in order to slide freely, but must not slide in their seats with excessive play. The seats of the needles in addition must be machined with a great deal of precision.

Furthermore controlling the reciprocal movement of the needles creates considerably problems of acceleration. Retaining the needles in place is difficult and the risk of breaking the filament can only be decreased by slowing down the working speed, which, therefore, increases product cost. Another considerable disadvantage is that the extremely complicated knitting machines are typically only usable for a particular cut, that is wales per inch, so that a great deal of equipment is necessary to produce different kinds of goods.

OBJECTS OF THE INVENTION

It is therefore an object of the present invention to provide an improved knitting method.

Another object is to provide an improved knitting apparatus.

Yet another object is the provision of such an apparatus which is relatively simple, can operate at high speed, and even allows the same machine to be set up to procude different gauge knitted goods.

SUMMARY OF THE INVENTION

These objects are achieved according to the present invention in an arrangement wherein the traditional hooks or needles are dispensed with and replaced by a loop forming element in the form of a generally cylindrical body. A loop is formed around the body and then a new section of filament is passed generally diametrically over the end of the body. This new section is retained on the body and the loop engaged around the body is passed over the end of the body by pulling on its two legs in order to surround the filament section secured to the end of the body and form it into a loop which is then slid down over the body to allow the process to be repeated.

In accordance with further features of this invention the knitting machine has a support provided with a plurality of seats each receiving a respective one of such bodies or pins, all of the bodies or pins equispaced apart and extending generally parallel to each other. The free end portion of each of the pins is formed with a loop-retaining groove extending angularly around the pin and having a pair of ends, with a cutout extending obliquely to the longitudinal axis of the body between the ends of the groove, and with a spur starting at one of the ends of the grooves and extending angularly toward the other end of the groove. Means is provided for periodically rotating these pins about their axes and for engaging a filament diametrically over the ends of the pins so that on each revolution the filament engaged over the pin end is caught by the spur and held as the loop already on the pin is pulled up over the caught filament.

With the system according to the present invention a relatively simple arrangement is used for forming the loops so that many of the problems encountered with sliding needles or hooks are avoided. This allows the cost of the knitting machine to be reduced considerably while at the same time it allows a single machine to be used with different loop-forming inserts of different cuts so that the overall number of machines necessary for a production line can be considerably decreased.

BRIEF DESCRIPTION OF THE DRAWING

FIGS. 4*a* – 7*a* are perspective views illustrating the method according to the present invention;

FIGS. 4*b* – 7*b* are top views illustrating the method in the positions shown in FIGS. 4*a* – 7*a*, respectively;

FIG. 8 is a vertical section, partly in diagrammatic form, through another apparatus in accordance with this invention;

FIG. 9 is a large-scale top view of the pin of FIG. 8; and

FIG. 10 is a perspective view of an upper portion of another loop-forming pin according to the present invention.

SPECIFIC DESCRIPTION

Figure 1:
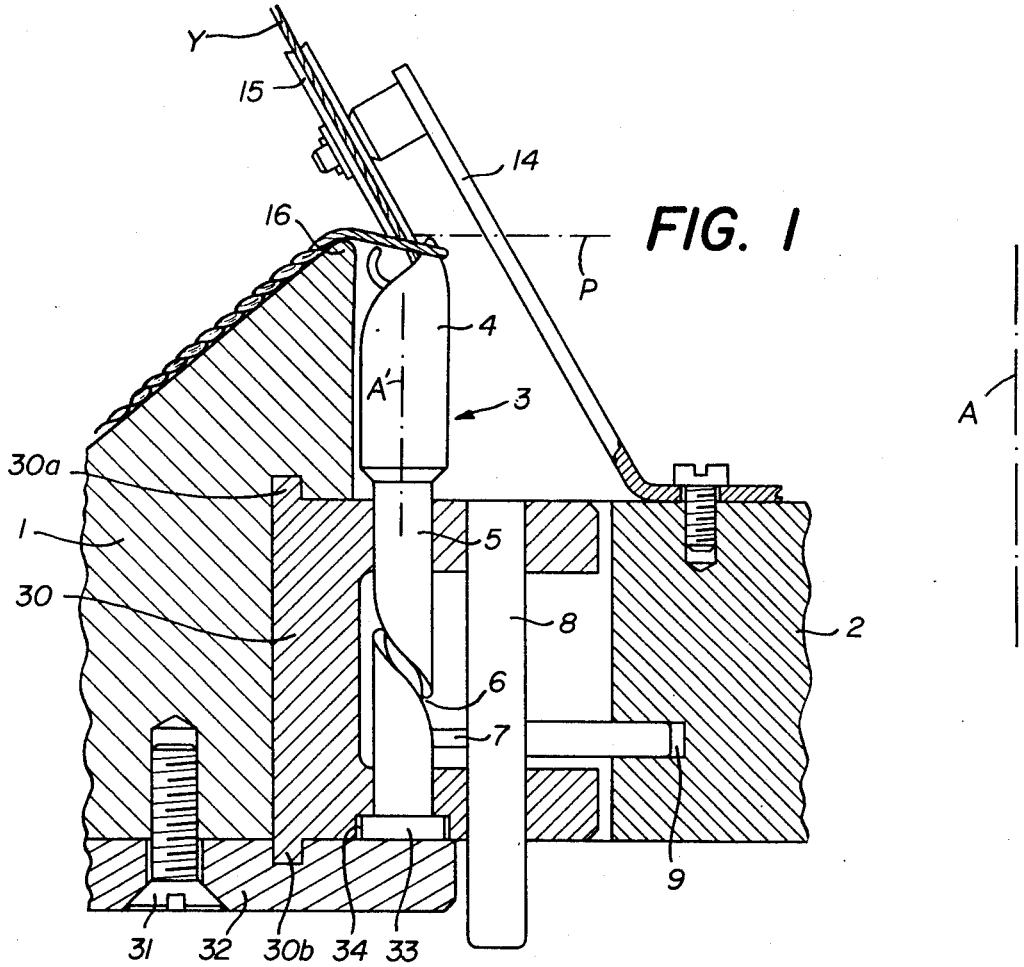
FIG. 1 is a vertical section through a portion of a knitting machine for carrying out the method of this invention.
Figure 2:
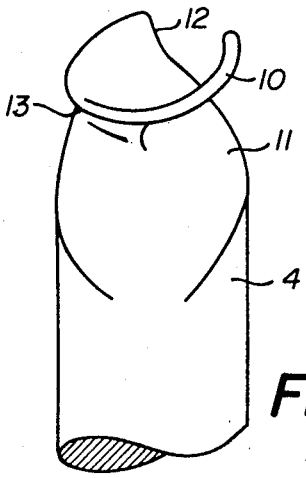
FIG. 2 is a perspective view of the top end of a loop-forming pin of the machine of FIG. 1.

FIG. 1 shows the support 1 of a rotary knitting machine that is rotatable about a vertical axis A relative to an internal housing 2. This support 1 carries a plurality of stitch- or loop-forming elements 3 having axes A′ parallel and equispaced around the rotation axis of the support 1.

Figure 3:
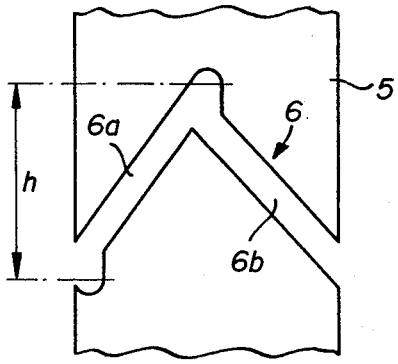
FIG. 3 is a side developed view of the cam groove in the pin of FIG. 2.

Each of these elements 3 is generally cylindrical and is subdivided into an upper part 4 for forming loops and a lower part 5. The lower part 5 has a groove 6 whose developed view is shown in FIG. 3 and in which is engaged a pin 7 fixed in a square-section vertically slidable rod 8 mounted in the support 1 parallel to the element 3. As seen in FIG. 3 the groove 6 is continuous completely around the cylindrical part 5 of the element 3 and is formed of two helical sections 6*a* and 6*b* inclined in opposite directions and intersecting each other a little short of each other's respective ends. The other end of the rod 7 is engaged in a sinusoidal groove 9 formed in the fixed housing 2 which serves as a control cam for the vertically displaceable rod 8. Thus as the support 1 rotates about the housing 2 the rod 9 rotates the element 3 about its axis A′. Each element 3 is axially fixed in the support 1 by a broadened head 3 on its lower end fixed in a recess 34 closed by a plate 32 held on the support 1 by a screw 31.

The upper end of the upper portion 4 is cut off at an inclined plane on which is formed a spur 10 which is itself formed from the inclined central portion of this zone and from a cutout 11 oblique at an angle of approximately 45° to the axis A′ of the element 3 and forming a ridge 12 whose upper edge is substantialy at the same level as the end of the spur 10. A groove 13 parallel to the plane of the spur 10 is formed between the ridge 12 and the starting point of the spur 10. In addition the support 1 is formed with rounded upper edges 16 concentric with the rotation axis A of this support 1 and lying in substantially the same plane P as the upper edge of the element 3, this plane P being perpendicular to the axis A′.

This apparatus has a thread feed system constituted in part by an arm 14 fixed to the nonmovable housing core 2 and having an end carrying a grooved pulley 15 rotatable in a plane generally perpendicular to that of the cutout 11 in the position of the element 3 as shown in FIG. 1 and with an edge adapted to lay a yarn Y between the free end of the spur 10 and the ridge 12 in this position of the element 3. As mentioned above the groove 9 in the support 2 is sinusoidal. The number of thread supplies is equal to the number of complete sine curves of the groove 9.

As the support 1 rotates about its axis A the groove 9 causes the sliding rod 8 to move up and down which causes the pin 7 to travel along the sections 6*a* and 6*b* of the groove 6. Since these groove sections 6*a* and 6*b* intersect one another short of their ends the pin 3 is thereby rotated undirectionally, transforming the alternating vertical reciprocation of the slider 8 into a nearly continuous unidirectional rotation of the element 3. At the same time this particular type of drive system always insures that the element 3 is in a given angular position relative to the angular position of the support 1 on the housing 2.

As shown in FIGS. 4*a* and 4*b* at the start of a single loop-forming operation a loop L is already engaged around the upper portion 4 and the yarn Y is laid by the feed pulley 15 such that it lays over the lowest part of the spur 10 but below its tip 10′. At the same time the loop L is engaged in the groove 13 below the tip 10′ of the spur 10.

Thereafter as shown in FIGS. 5*a* and 5*b* continuous rotation of the element 3 in the direction of arrow F brings the tip 10′ over the of the yarn Y, but the loop L is cammed up by the ridge 12 so that it passes over the spur 10.

FIGS. 6*a* and 6*b* show how the element 3 on continued rotation sheds the loop L which is pulled downwardly by the weight of the knitted goods passing down around support 1, and forms a new loop L′ with the filament Y.

This new loop L′ is thereafter moved down in the groove 13 as shown in FIGS. 7*a* and 7*b* so as to allow a new filament over top of it and another course to be formed in the weft-knitted goods.

It is noted that the original loop L is pulled generally upwardly off the pin 3 by the weight of the goods being pulled centrifugally outward by the rotating support 1. At the same time however the hooking action of the spur 10 and the shape of the groove 13 tends to draw the filament Y downwardly in a generally opposite direction.

FIG. 8 shows another arrangement in accordance with this invention wherein the loop-forming element 17 is formed by a tubular body cut at its end along a plane perpendicular to its longitudinal axis. A spur 18 is formed by a throughgoing slot 19 and is bent slightly inwardly as shown in FIG. 9. In addition the tip of the spur 18 is bent slightly downwardly below the plane P″ of the end of the tube 17 so that a loop is shed it is not caught by this tip 18′. Thus, the new filament section must be introduced into the hollow lowered section of the body 17 in order that the spur 18, while turning, catches this new section of filament and pulls it under the previously formed loop formed on the body 17 in the manner described above with reference to FIGS. 4*a* – 7*b*. This deep introduction is facilitated by means of a venturi loader comprising a feed tube 20 in line with the axis of the tube 17 and surrounded by a further venturi tube 21 connected via an inlet 22 to a blower 23 and having an outlet 24 downstream of the end of the tube 20 and directed into the tube 17. A feed device 25 comprising a pair of rollers 26 and 27 driven in opposite directions $S_1$ and $S_2$ serves to feed a new yarn Y′ into the tube 20 at a predetermined rate determined by the rotation rate of the support 1.

FIG. 10 shows another arrangement wherein an outer tube 28 is fitted with a plug 29 having an oblique end surface 29′. In addition the tube 28 is formed with a spur 28′ bent inwardly above a notch or groove 30 cut in the end of the tube 28.

The arrangement shown in FIG. 1 has a loop-forming part 3 formed of two sections 4 and 5. With this arrangement it is possible to change the gauge or cut of the knitting machine by simply changing the element or elements 30 supporting the parts 3. Thus it is possible to have a knitting machine in which a plurality of different collars or rings 30 can be set, each of which has a different cut. To this end the pieces 30 have ridges 30*a* and 30*b* fit within corresponding groups in the part 1 and the plate 32 so as to hold it rigidly in place. In practice it has been found that the parts 3 are best nested in a plurality of separate elements 30 each formed as sections of a circular annulus. In order to change from one cut to another the operator withdraws all of the screws 31 and the sector plates 32, then replaces the various sectors 30 with sectors having differently angularly spaced elements 3. Thus it is possible to use a single knitting machine for producing knitted goods of different gauge.

It is also within the scope of the present invention to arrange the elements 3 in a straight line. In such a flat bed machine the interchangeability of the elements 30 can also be provided.

We claim:

1. A knitting method comprising the steps of sequentially:

a. forming a filament loop around a cylindrical body, b. disposing another filament section diametrically over the end of said body, c. retaining said section at said end of said body, d. sliding said loop off said body over said end by pulling on the legs of said loop in a first direction to surround said section of filament to each side of said end of said body, e. pulling said section surrounded by said loop in a second direction opposite said first direction to form another such loop around said body, and f. repeating steps (b) through (e) with the loop formed in step (e).

2. The method defined in claim 1 wherein said body has an angularly extending spur and said section is retained by rotating said body to catch said section under said spur.

3. The method defined in claim 2 wherein said body has a ridge, said loop being slid off by rotating said body and riding said loop up on said ridge over said spur.

4. The method defined in claim 3 wherein said section is retained against an eccentric location on an end of said body and said section is pulled in said second direction by rotating said body about an axis offset from said eccentric location.

5. A support having an array of elongated seats having parallel longitudinal axes;

an elongated loop-forming pin in each of said seats centered on and rotatable about the respective longitudinal axis thereof and having an end portion formed with a loop-receiving groove itself having a pair of ends and with cutout oblique to the respective axis and extending between the ends of the respective groove, and with a spur extending from one of said ends of the respective groove angularly toward the other end of the respective groove;

means for periodically rotating each of said pins without longitudinal movement about its respective axis; and means for feeding a filament diametrically across the ends of said pins.

6. The apparatus defined in claim 5 wherein said end of each body terminates at a point in a plane perpendicular to the respective longitudinal axis, said spur lying fully to one side of said plane.

7. The apparatus defined in claim 6 wherein each body is formed with a circumferential cam groove, said means for rotating including a periodically reciprocal element engaging in said cam groove.

8. The apparatus defined in claim 7 wherein each body is fixed against axial displacement.

* * * * *